US010508016B1

(12) United States Patent
Laible

(10) Patent No.: US 10,508,016 B1
(45) Date of Patent: Dec. 17, 2019

(54) CONTAINER INSERT FOR USE IN A CLOSED LOOP DISPENSING SYSTEM

(71) Applicant: Rodney Laible, Omaha, NE (US)

(72) Inventor: Rodney Laible, Omaha, NE (US)

( * ) Notice: Subject to any disclaimer, the term of this patent is extended or adjusted under 35 U.S.C. 154(b) by 0 days.

(21) Appl. No.: 16/427,548

(22) Filed: May 31, 2019

(51) Int. Cl.
*B67D 7/02* (2010.01)

(52) U.S. Cl.
CPC ..... *B67D 7/0277* (2013.01); *B67D 7/0294* (2013.01)

(58) Field of Classification Search
CPC ..... B67D 7/0277; B67D 7/0294; B67D 7/36; B67D 7/00; B67D 7/02; B67D 7/0288
USPC ..... 222/481.5
See application file for complete search history.

(56) References Cited

U.S. PATENT DOCUMENTS 5,445,186 A * 8/1995 Richter ..... B65D 47/2075 137/614.03
5,988,456 A * 11/1999 Laible ..... B67D 7/0294 222/464.1
6,142,345 A * 11/2000 Laible ..... B67D 7/0277 222/189.1
6,669,062 B1 * 12/2003 Laible ..... B67D 7/0294 141/244
6,968,983 B2 11/2005 Laible
6,986,443 B2 * 1/2006 Laible ..... B67D 7/0294 222/181.1
7,121,437 B2 * 10/2006 Kasting ..... B65D 47/242 222/482
9,126,725 B1 * 9/2015 Laible ..... B65D 25/50
9,242,847 B1 * 1/2016 Laible ..... B67D 7/0294
9,648,992 B2 * 5/2017 Harris ..... B05B 11/00442
10,160,590 B2 * 12/2018 Wells ..... B65D 83/16
10,301,088 B1 * 5/2019 Laible ..... B65D 51/16
10,336,517 B1 * 7/2019 Laible ..... B65D 55/02
10,414,644 B1 * 9/2019 Laible ..... B67D 7/0294
10,414,645 B1 * 9/2019 Laible ..... B67D 7/04
2003/0150887 A1 * 8/2003 Laible ..... B67D 7/0294 222/529
2010/0213215 A1 * 8/2010 Laible ..... B67D 7/02 222/185.1
2010/0213220 A1 * 8/2010 Laible ..... B67D 7/0277 222/481.5
2010/0258593 A1 * 10/2010 Laible ..... B65D 47/283 222/478
2012/0104029 A1 * 5/2012 Haas ..... B67D 7/0294 222/1

* cited by examiner

*Primary Examiner* — Benjamin R Shaw
(74) *Attorney, Agent, or Firm* — Dennis L. Thomte; Thomte Patent Law Office LLC

(57) ABSTRACT

A container insert is disclosed for use in a closed loop dispensing system. The insert is press-fitted into the throat of a liquid container. The insert includes a plastic retainer having a plastic spring over-molded thereon. The plastic spring replaces the prior art metal spring. The container insert is completely recyclable and is automatically self-venting.

3 Claims, 7 Drawing Sheets

CONTAINER INSERT FOR USE IN A CLOSED LOOP DISPENSING SYSTEM

BACKGROUND OF THE INVENTION

Field of the Invention

This invention relates to a container insert for use in a closed loop dispensing system. More particularly, this invention relates to a container insert which is press-fitted into the throat of a liquid container. Even more particularly, this invention relates to a container insert which is completely recyclable. Even more particularly, the container insert of this invention is automatically self-venting. Even more particularly, a portion of the container insert of this invention is manufactured by an over-molding process which reduces overall part count, overall assembly time and cost.

Description of the Related Art

Many container inserts have been provided for insertion into the throat of a container containing liquid chemical. Applicant has previously received U.S. Pat. Nos. 9,242,847; 6,968,983; 6,669,062; 6,142,345 and 5,988,456 wherein inserts have been provided which are inserted into the throat of a liquid container. Applicant's earlier patents represent an advance in closed loop dispensing systems. However, the container inserts of Applicant's earlier patents involve considerable parts requiring some assembly time. Further, some of Applicant's earlier container inserts included metal springs thereby preventing the container inserts from being completely recyclable due to the metal springs thereof which had to be separated from the container insert before the remaining components could be recycled. Additionally, the metal springs in Applicant's earlier container inserts could deteriorate over time due to their exposure to chemicals.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

An insert is provided for use with a closed loop dispensing system including a container having a throat with an inside surface. The insert of this invention is inserted downwardly into the throat of the container. The insert includes a generally cylindrical and hollow first receiver tube, having upper and lower ends, with the first receiver tube being vertically disposed. A horizontally disposed and annular first shoulder extends inwardly from the upper end of the first receiver tube. The insert also includes a generally cylindrical and hollow second receiver tube, having upper and lower ends, which extends upwardly from the first shoulder outwardly of the inner end of the first shoulder. A first receiver tube defines a first passageway and the second receiver tube defines a second passageway. The insert includes an upstanding hollow valve stem having an upper end, a lower end, an outer surface and an inner surface with the valve stem having an upper tubular member and a lower tubular member. The upper tubular member has a greater diameter than the lower tubular member. A second annular shoulder, having an upper end and a lower end, extends outwardly from the valve stem between the upper and lower ends thereof. The valve stem is vertically movably positioned in the first and second receiver tubes between upper and lower positions. The upper end of the second annular shoulder of the valve stem is in engagement with the lower end of the first shoulder when the valve stem is in its upper position. The insert further includes a plastic retainer which is configured to be inserted into the lower end of the lower wall member. The retainer includes a horizontally disposed disc member having a plurality of radially spaced-apart openings extending downwardly therethrough. The disc member of the retainer has a hollow dip tube support extending downwardly therefrom. The disc member of the retainer has a central opening. The retainer includes an elongated hollow valve body, having an open lower end and a closed upper end, which is integrally formed with the disc member of the retainer. The valve body extends upwardly from the disc member of the retainer whereby the open lower end of the valve stem is in communication with the central opening of the disc member of the retainer. The valve body has at least one opening formed therein below the closed upper end thereof.

A plastic spring is over-molded on the retainer and includes a hollow upper cylindrical portion, having a lower end and an upper end. The plastic spring has a horizontally disposed disc portion at the lower end of the upper cylindrical portion thereof. The disc portion of the plastic spring has a plurality of spaced-apart hollow protrusions formed therein. The hollow protrusions are received in the openings formed in the disc member of the retainer. Each of the hollow protrusions have an open upper end and a lower end. Each of the protrusions have a bi-directional slit-type valve formed in the lower end thereof. The upper end of the cylindrical portion of the plastic spring is in engagement with the annular shoulder of the valve stem to urge the valve stem upwardly to its closed position thereby closing the opening in the upper end of the valve body. The upper end of the cylindrical portion of the plastic spring is compressed downwardly upon downward force being applied to the upper end of the valve stem to open the openings in the upper end of the valve.

It is therefore a principal object of the invention to provide an improved container insert for use in a closed loop dispensing system.

A further object of the invention is to provide a container insert which includes a retainer therein with the retainer having a plastic spring over-molded thereon.

A further object of the invention is to provide a container insert which is completely recyclable.

A further object of the invention is to provide a container insert wherein an over-molded spring urges the valve stem thereof to its closed position but may be compressed to permit the valve stem to move downwardly to open the valve.

A further object of the invention is to provide a container insert which reduces the cost of manufacturing the same due to an over-molding process that reduces the overall part count and overall assembly time.

A further object of the invention is to provide a container insert which is automatically self-venting.

A further object of the invention is to provide a container insert which includes a plurality of bi-directional valves for air venting and chemical off-gassing.

A further object of the invention is to provide a container insert which is economical of manufacture and durable in use.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
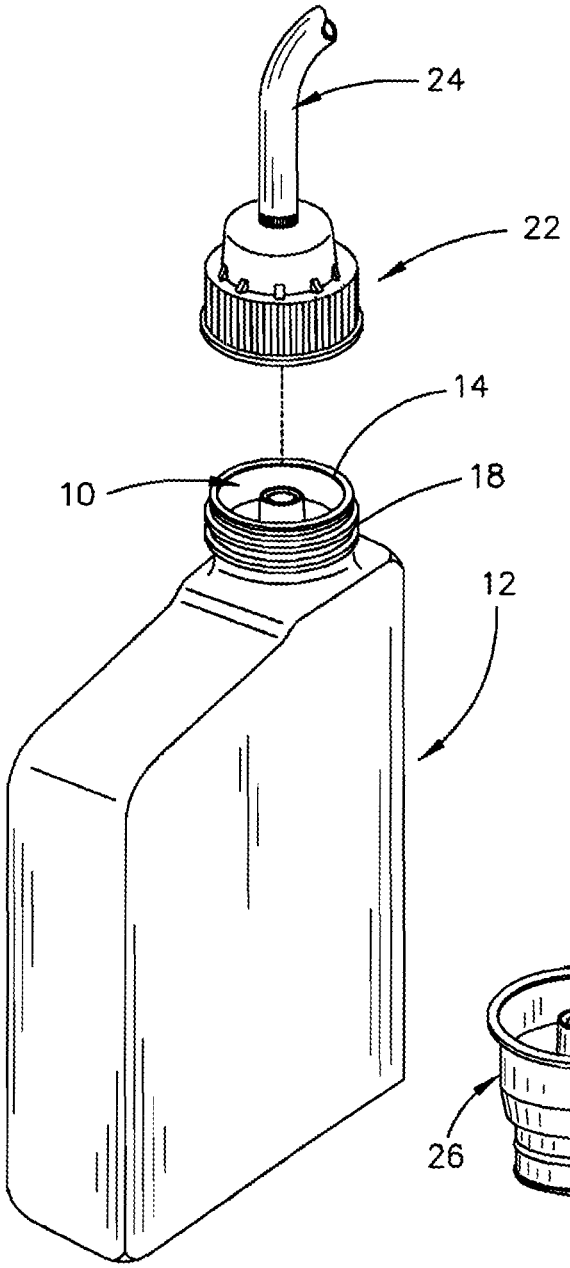
FIG. 1 is an exploded perspective view of a liquid container, having the container insert of this invention mounted in the throat thereof and a liquid dispensing cap.
Figure 2:
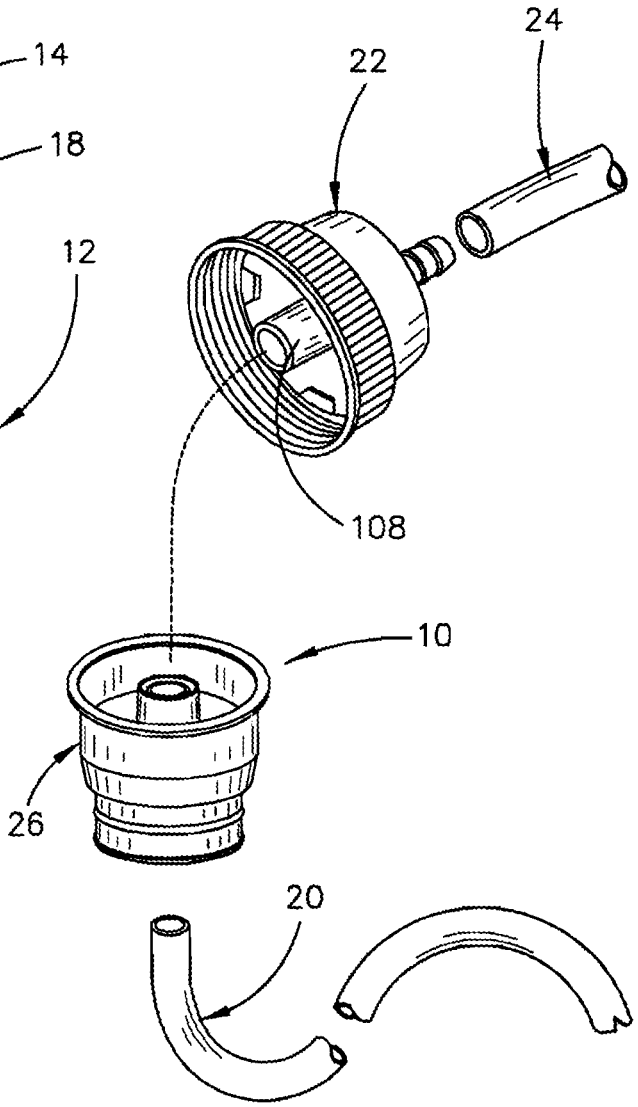
FIG. 2 is an exploded perspective view of the container insert, dip tube and a liquid dispensing cap.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to the container insert of this invention which is used in a closed loop dispensing system. The closed loop dispensing system includes a container 12 having a throat 14 at its upper end and which has an inner surface 16 (not shown) and an externally threaded outer surface 18. As will be explained hereinafter, insert 10 is selectively removably positioned in the throat 14 of the container 12 as described in Applicant's earlier patents. A dip tube 20 is secured to the lower end of insert 10 as will be described hereinafter. Dip tube 20 extends downwardly into container 12 in conventional fashion. As will be described hereinafter, a dispenser cap assembly 22 is selectively threadably secured to the externally threaded outer surface 18 of throat 14. As will be described hereinafter, a dispensing tube 24 extends from extends from dispenser cap assembly 22 to a mixing machine, mixer, dispenser, container, etc. as described in Applicant's earlier patents.

Insert 10 includes a body portion 26 which is comprised of a suitable plastic material. Body portion 26 includes a horizontally disposed and ring-shaped lip 28. A generally cylindrical upper wall member 30 extends downwardly from the inner end of lip 28 and has an upper end 32 and a lower end 34. The numeral 36 refers to a horizontally disposed and disc-shaped wall or shoulder which extends inwardly from the lower end 34 of upper wall member 30. A generally cylindrical and hollow lower wall member 38 extends downwardly from upper wall member 30 inwardly of the lower end 34 of upper wall member 30. Lower wall member 36 will be described as having an upper end 40 and a lower end 42. The outer side of lower wall member 38 has a plurality of ring-shaped gripping members 44 extending therefrom.

The numeral 46 refers to a horizontally disposed wall which extends inwardly from lower wall member 38. Wall 46 has a plurality of radially spaced-apart openings 48 formed therein.

A cylindrical receiver 50 extends upwardly from the inner end of wall 46. Receiver 50 has a reduced diameter portion 52 and which defines an annular shoulder 54 therebetween. An annular shoulder 56 extends inwardly from receiver 50. The reduced diameter portion 52 will be described as having an upper end 58.

The numeral 60 refers to a hollow valve stem having a cylindrical upper end portion 62 with an upper end 64. An annular shoulder 66 extends outwardly from upper end portion 62 at the lower end thereof. Valve stem 60 also includes a cylindrical lower end portion 68 having an upper end 70 and a lower end 72. Lower end portion 68 has a cylindrical bore 73 extending therethrough.

The numeral 74 refers to a plastic retainer having a plastic spring 76 over-molded thereon. Spring 76 is preferably comprised of thermo plastic elastomer TPE. Retainer 74 includes a disc member 78 having a plurality of radially spaced-apart openings 80 extending therethrough. Disc member 78 may have external threads formed therein. Hollow dip tube support 82 extends downwardly from disc member 78 and has the upper end of the curved dip tube 20 mounted therein which extends downwardly into the container 12. The numeral 84 refers to a hollow valve body which is integrally formed with disc member 78 and which is in communication with the interior of dip tube support 82. Valve body 84 is elongated and extends upwardly from disc member 78. The upper end of valve body 84 is closed. The side wall of valve body 84, below the upper end thereof, is preferably provided with a pair of openings 86 formed therein to permit the liquid being drawn from the container 12, through dip tube 20, to pass upwardly through valve body 84 and outwardly through the opening 86, as will be described in detail hereinafter.

Figure 3:
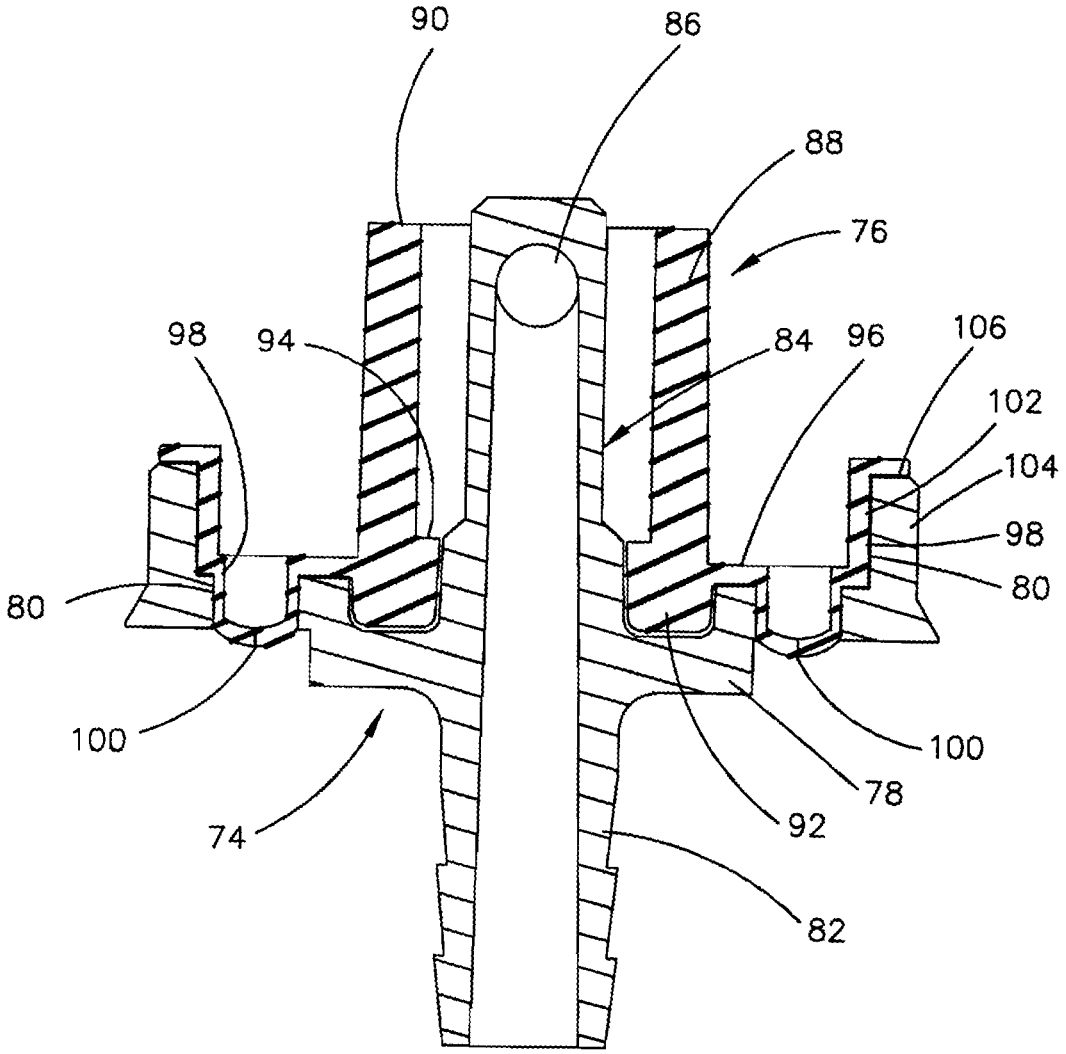
FIG. 3 is a sectional view of over-molded retainer and plastic valve of this invention.
Figure 4:
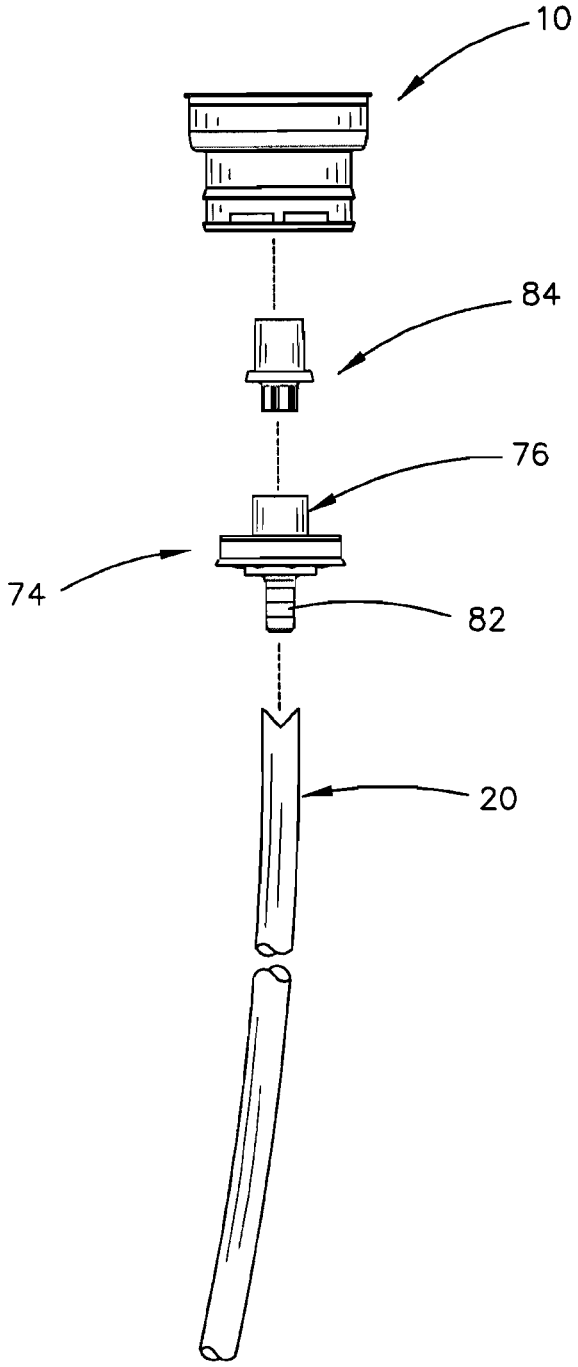
FIG. 4 is an exploded view of the container insert, valve stem, over-molded retainer and plastic spring and the dip tube of this invention.
Figure 5:
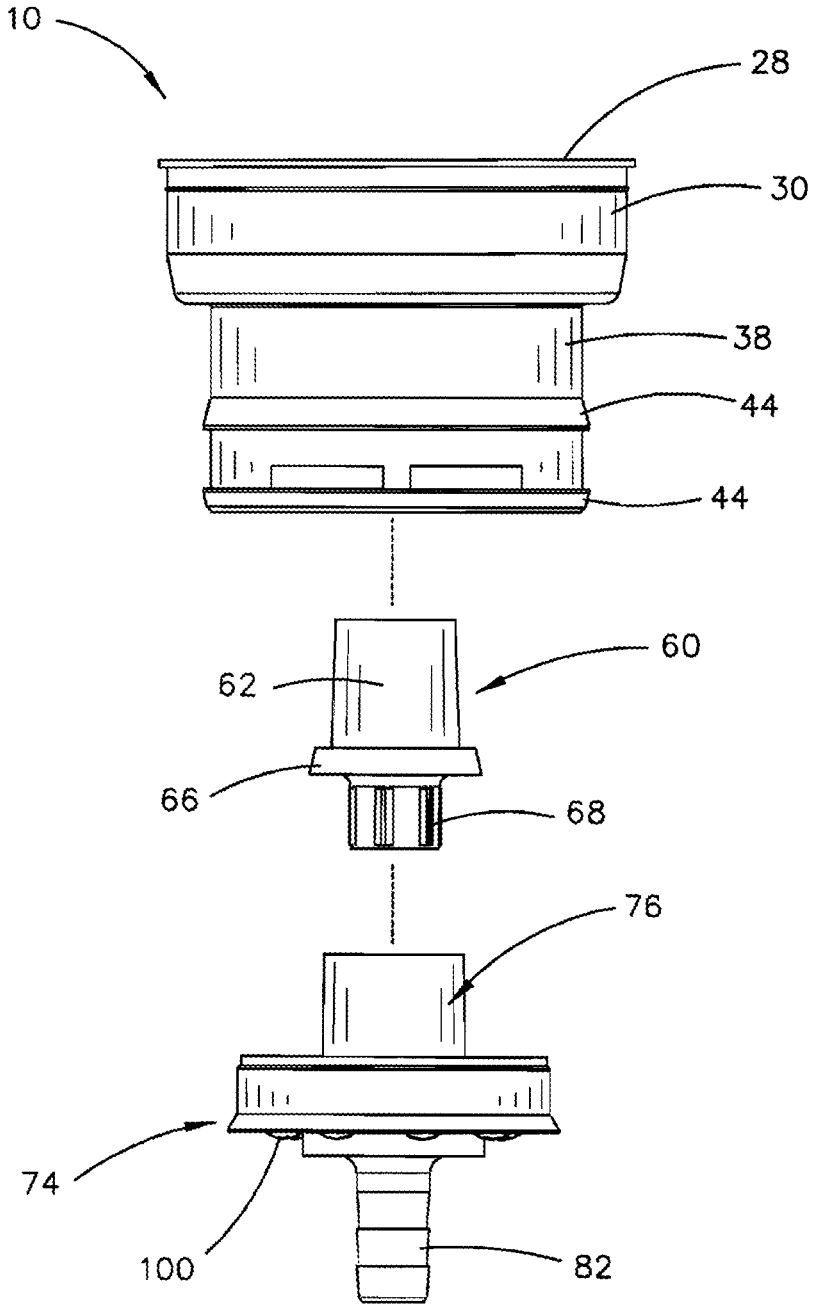
FIG. 5 is an exploded side view of the container insert, valve stem and the over-molded retainer and plastic valve.
Figure 6:
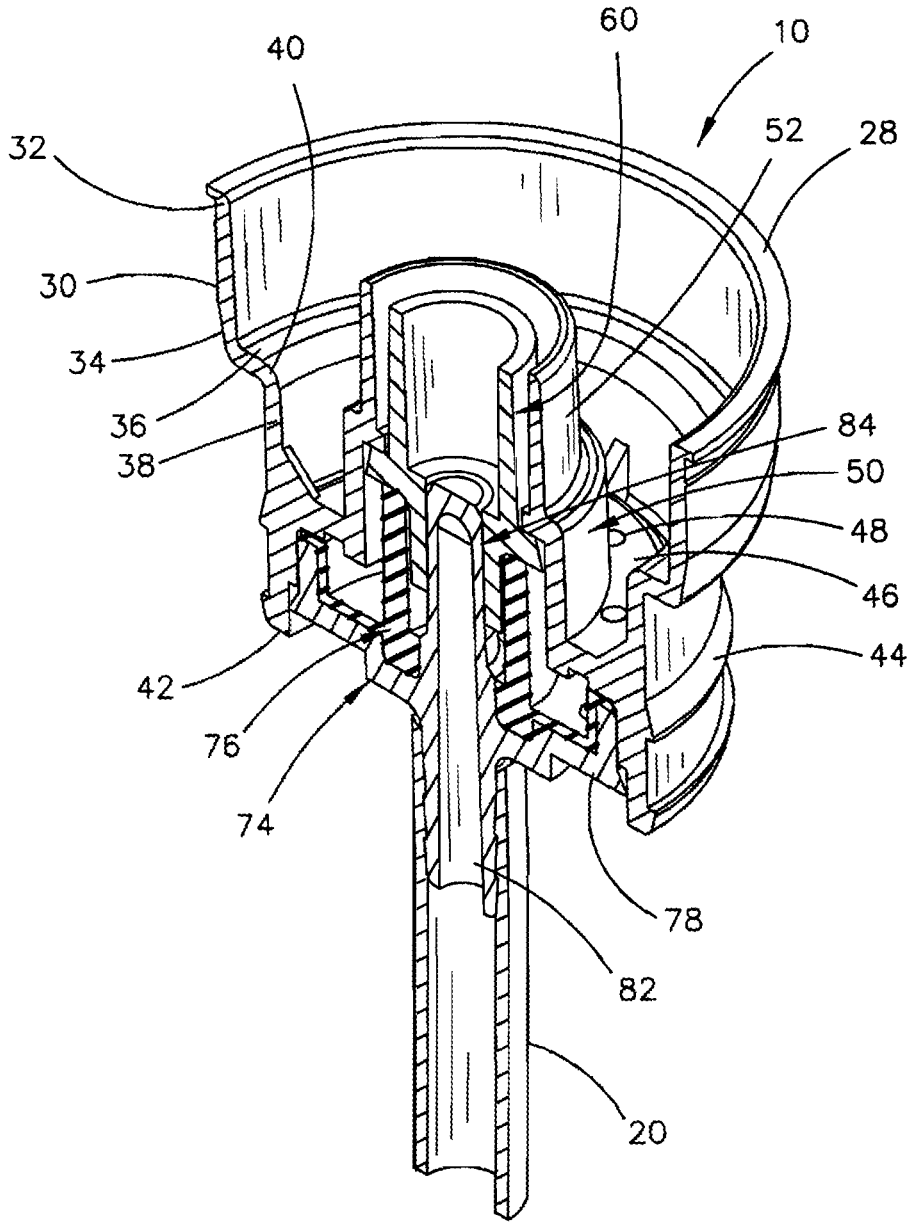
FIG. 6 is a sectional perspective view of the container insert of this invention.

Spring 76 includes an upper tubular or hollow cylindrical portion 88 having an upper end 90. The lower end of cylindrical portion 88 has an enlarged portion 92 which defines an inwardly projecting shoulder 94. Spring 76 includes a horizontally disposed disc portion 96 which extends outwardly from cylindrical portion 88 at the lower end thereof. Disc portion 96 has a plurality of spaced-apart protrusions 98 formed therein which are received in the openings 80 of disc member 78 of retainer 74. A plastic or rubber bi-directional slit-type valve 100 is positioned in each of the lower ends of the protrusions 98. Plastic spring 76 includes an upstanding outer wall 102 which is over-molded onto the vertically disposed outer wall 104 of retainer 74 and the upper end 106 of retainer 74 as seen in FIG. 3. The retainer 74 with the over-molded spring 76 thereon is snap-fitted into the lower end of insert 10 so that the open upper ends of the protrusions 98 of spring 76 register with the openings 48 formed in wall 46 of insert 10.

Figure 7:
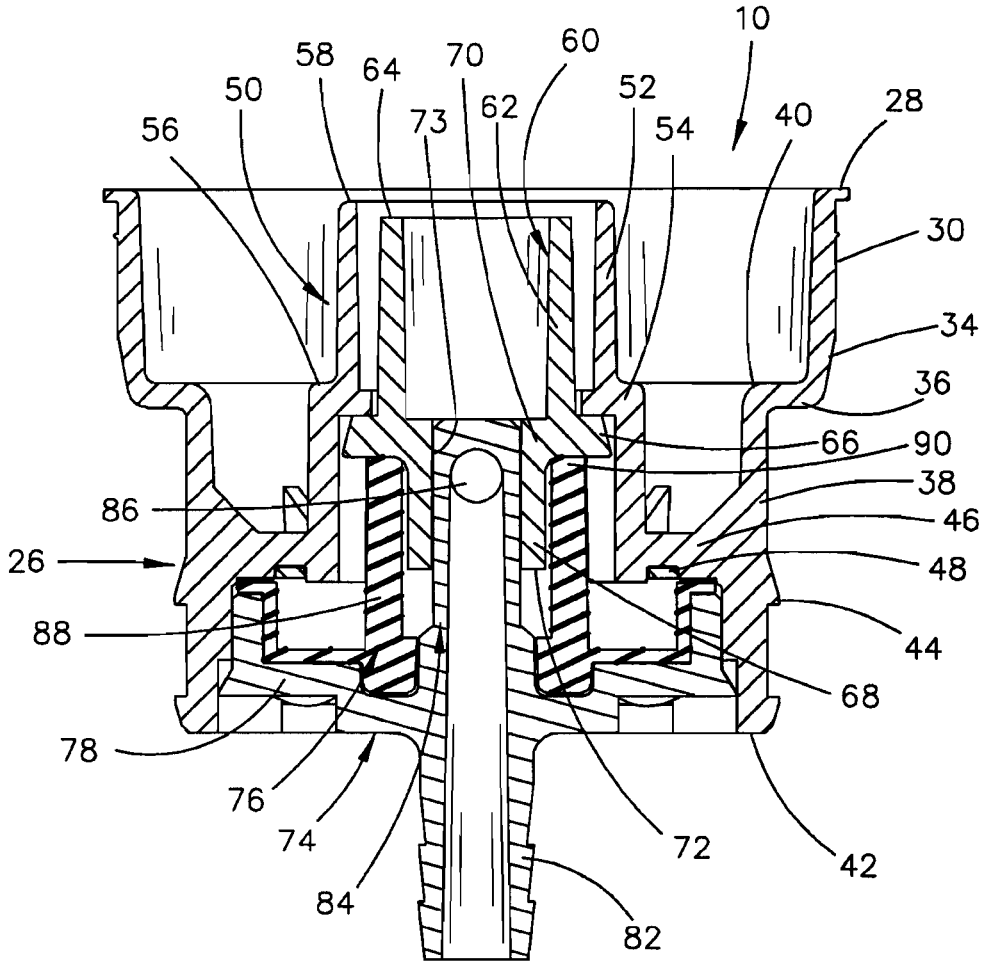
FIG. 7 is a sectional view of the container insert of this invention with the plastic over-molded valve being in its upper position.

When the retainer 74 and spring 76 are inserted into the lower end of insert 10, the upper end 90 of cylindrical portion 88 of spring 76 engages the underside of shoulder 66 of valve stem 60 to yieldably urge the valve stem 60 to its upper closed position of FIG. 7. At that time, shoulder 66 of valve stem 60 will engage the underside of shoulder 56. At that same time, the lower end portion 68 of valve stem 60 will close the openings 86 of valve body 84.

The valve stem 60 will remain in its closed position by the resiliency of the cylindrical portion 88 of spring 76. If the pressure within the container 12 rises to a certain level, the gases in container 12 may pass upwardly through the valves 100 in protrusions 98. The bi-directional valves 100 will not permit liquid in the container to flow outwardly therethrough when in their closed position.

Figure 8:
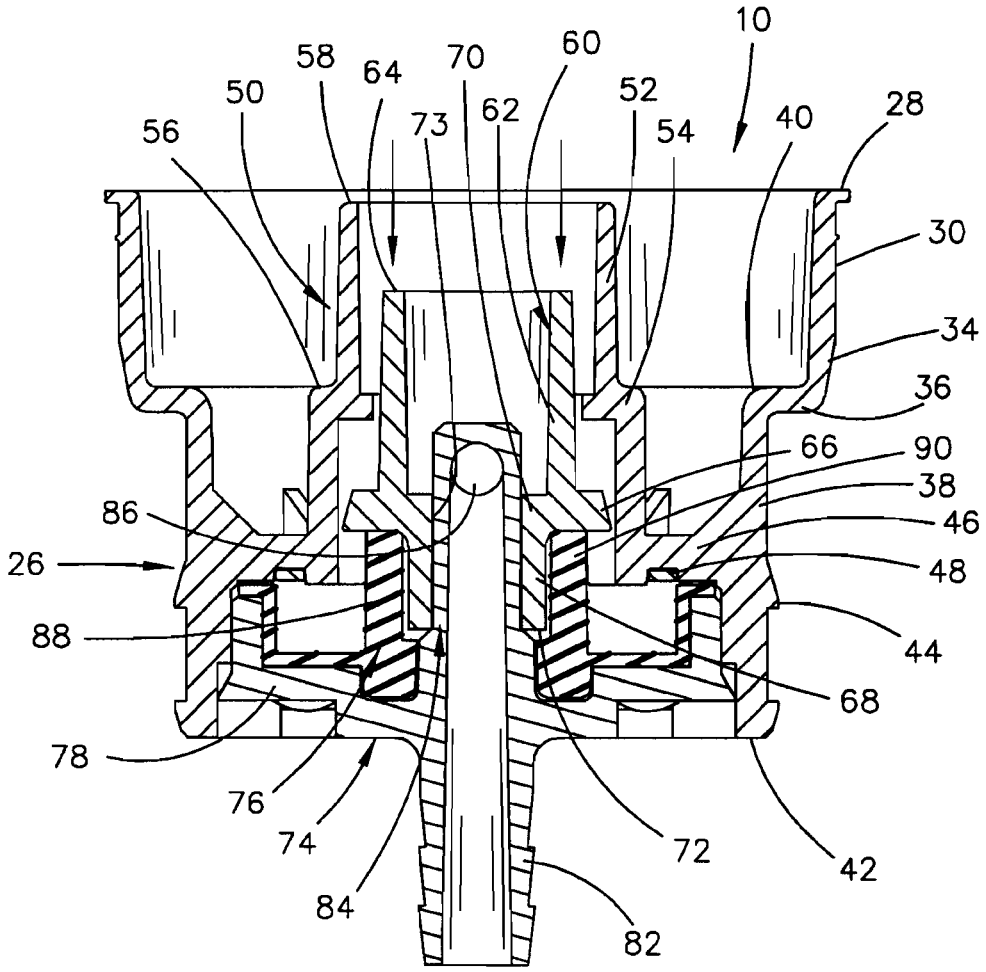
FIG. 8 is a sectional view of the container insert of this invention with the plastic over-molded valve being in its lower position.

When it is desired to supply the liquid chemical in the container 12 to a mixer or the like, the dispensing cap assembly 22 will be screwed onto the threads 18 of container 12. At that time, the hollow cylindrical member 108 of shipping cap assembly 22 will engage the upper end 64 of valve stem 60 and move the valve stem 60 to the lower position of FIG. 8 so that the openings 86 in valve body 84 will be open so that liquid in the container 12 may be drawn therethrough. The downward movement of valve stem 60 causes the cylindrical portion 88 of spring 76 to be downwardly compressed. When the shipping cap assembly 22 is removed from the insert 10, the resiliency of the compressed cylindrical portion 88 will expand to move the valve stem 60 upwardly to its closed position.

When liquid is being drawn from the container 12, the bi-directional valves 100 will open to permit air to enter the container 12 to replace the liquid being drawn therefrom to prevent the container from collapsing inwardly. The fact that the plastic spring 76 is over-molded onto the retainer 74 reduces the overall part count, overall assembly time and cost. It can also be seen that the insert 10 is completely recyclable due to the fact that there are no metal parts in the insert 10.

Thus it can be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. An insert for use with a closed loop dispensing system including a container having a throat with an inside surface, comprising:

a horizontally disposed ring-shaped lip having an upper side, a lower side, an outer end, and an inner end;

a generally cylindrical upper wall member having an open upper end, an open lower end, an inner surface and an outer surface;

a horizontally disposed first wall member extending inwardly from said lower end of said upper wall member with said first wall member having an inner end;

a generally cylindrical lower wall member having an open upper end, an open lower end, an inner surface and an outer surface;

said lower wall member extending downwardly from said inner end of said first wall member;

said lower wall member having at least one annular retaining member extending outwardly from said outer surface thereof;

a horizontally disposed second wall member having inner and outer ends;

said second wall member extending inwardly from said lower wall member above said lower end of said lower wall member;

said second wall member having an inner end;

a generally cylindrical and hollow first receiver tube having upper and lower ends;

said first receiver tube being vertically disposed;

said first receiver tube extending upwardly from said inner end of said second wall member;

a horizontally disposed and annular first shoulder extending inwardly from said upper end of said first receiver tube;

said first shoulder having inner and outer ends;

a generally cylindrical and hollow second receiver tube having upper and lower ends;

said second receiver tube extending upwardly from said first shoulder outwardly of said inner end of said first shoulder;

said first receiver tube defining a first passageway;

said second receiver tube defining a second passageway;

an upstanding hollow valve stem having an upper end, a lower end, an outer surface and an inner surface;

said valve stem having an upper tubular member and a lower tubular member;

said upper tubular member having a greater diameter than said lower tubular member;

a second annular shoulder, having an upper end and a lower end, extending outwardly from said valve stem between said upper and lower ends thereof;

said valve stem being vertically movably positioned in said first and second receiver tubes between upper and lower positions;

said upper end of said second annular shoulder of said valve stem being in engagement with said lower end of said first annular shoulder when said valve stem is in said upper position;

a retainer configured to be inserted into said lower open end of said lower wall member;

said retainer including a horizontally disposed disc member having a plurality of radially spaced-apart openings extending downwardly therethrough;

said disc member of said retainer having a hollow dip tube support extending downwardly therefrom;

said disc member of said retainer having a central opening formed therein;

said retainer including an elongated hollow valve body, having an open lower end and a closed upper end, which is integrally formed with said disc member;

said valve body extending upwardly from said disc member of said retainer whereby said open lower end of said valve stem is in communication with said central opening of said disc member;

said valve body having at least one opening formed therein below said closed upper end of said valve body;

a plastic spring over-molded thereon on said retainer;

said plastic spring including a hollow upper cylindrical portion having a lower end and an upper end;

said plastic spring having a horizontally disposed disc portion at said lower end of said upper cylindrical portion thereof;

said disc portion of said plastic spring having a plurality of spaced-apart hollow protrusions formed therein;

said hollow protrusions being received in said openings formed in said disc member of said retainer;

each of said hollow protrusions having an open upper end and a lower end;

each of said protrusions having a bi-directional slit-type valve formed in said lower end thereof;

said upper end of said upper cylindrical portion of said plastic spring being in engagement with said annular shoulder of said valve stem to urge said valve stem to its closed position thereby closing said opening in said upper end of said valve stem; and said upper end of said cylindrical portion of said plastic spring being compressed downwardly upon downward force being applied to said upper end of said valve stem to open said at least one opening in said upper end of said valve.

2. In combination:

a container insert for use with a closed loop dispensing system;

said container insert having an open upper end and an open lower end;

a valve stem vertically movably mounted in said container insert;

said valve stem being movable between an upper position and a lower position;

a plastic retainer configured to be inserted into said lower open end of said insert;

said retainer including a horizontally disposed disc member having a plurality of radially spaced-apart openings extending downwardly therethrough;

said disc member of said retainer having a hollow dip tube support extending downwardly therefrom;

said disc member of said retainer having a central opening formed therein;

said retainer including an elongated and vertically disposed hollow valve body, having an open lower end and a closed upper end, which is integrally formed with said disc member of said retainer;

said valve body extending upwardly from said disc member of said retainer;

said valve body having at least one opening formed therein below said closed upper end of said valve body;

said valve stem closing said at least one opening in said valve body when said valve stem is in said upper position;

said at least one opening in said valve body being open when said valve stem is in said lower position;

a plastic spring over-molded on said retainer;

said plastic spring including a hollow upper cylindrical portion having a lower end and an upper end;

said plastic spring having a horizontally disposed disc portion at said lower end of said upper cylindrical portion thereof;

said disc portion of said plastic spring having a plurality of spaced-apart hollow protrusions formed therein which extend downwardly from said disc portion of said plastic spring;

said hollow protrusions being received in said openings formed in said disc member of said retainer;

each of said hollow protrusions having an open upper end and a lower end;

each of said protrusions having a bi-directional slit-type valve formed in said lower end thereof;

said upper end of said upper cylindrical portion of said plastic spring being in engagement with said valve stem to urge said valve stem to its upper position thereby closing said at least one opening in said upper end of said valve body; and said upper end of said cylindrical portion of said plastic spring being compressed downwardly upon downward force being applied to said upper end of said valve stem to open said at least one opening in said upper end of said valve body.

3. A plastic retainer for use in a container insert of a closed loop dispensing system, comprising:

a horizontally disposed disc member having a plurality of radially spaced-apart openings formed therein;

said disc member of said retainer having a hollow dip tube support extending downwardly therefrom;

said disc member of said retainer having a central opening formed therein;

said retainer including an elongated and vertically disposed hollow valve body, having an open lower end and a closed upper end, which is integrally formed with said disc member of said retainer;

said valve body extending upwardly from said disc member of said retainer;

said valve body having at least one opening formed therein below said closed upper end of said valve body;

a plastic spring over-molded on said retainer;

said plastic spring including a hollow upper cylindrical portion having a lower end and an upper end;

said plastic spring having a horizontally disposed disc portion at said lower end of said upper cylindrical portion thereof;

said disc portion of said plastic spring having a plurality of spaced-apart hollow protrusions formed therein which extend downwardly from said disc portion of said plastic spring;

said hollow protrusions being received in said openings formed in said disc member of said retainer;

each of said hollow protrusions having an open upper end and a lower end;

each of said protrusions having a bi-directional slit-type valve formed in said lower end thereof; and said upper cylindrical portion of said plastic spring being compressed downwardly upon downward force being applied to said upper end of said upper cylindrical portion thereof.

* * * * *